United States Patent [19]

Flynn

[11] 4,082,646

[45] Apr. 4, 1978

[54] COKING OF BITUMINOUS SOLIDS WITH HOT SOLIDS RECYCLE

[75] Inventor: Peter Charles Flynn, Edmonton, Canada

[73] Assignees: Petro-Canada Exploration Inc., Calgary; Her Majesty the Queen in right of the Province of Alberta, Government of the Province of Alberta, Department of Energy and Natural Resources, Alberta Syncrude Equity, Edmonton; Ontario Energy Corporation; Imperial Oil Limited, both of Toronto; Canada-Cities Service, Ltd., Calgary; Gulf Oil Canada Limited, Toronto, all of Canada

[21] Appl. No.: 807,349

[22] Filed: Jun. 17, 1977

[51] Int. Cl.[2] ..... C10G 1/02

[52] U.S. Cl. ..... 208/11 R; 201/12; 201/16

[58] Field of Search ..... 208/11 R; 201/16, 20, 201/12

[56] References Cited

U.S. PATENT DOCUMENTS

| | | | |
|---|---|---|---|
| 2,905,595 | 9/1959 | Berg | 208/11 R |
| 3,261,775 | 7/1966 | Blaser | 208/11 R |
| 3,267,019 | 8/1966 | Fitch | 208/11 R |
| 3,320,152 | 5/1967 | Nathan et al. | 208/11 R |
| 3,518,181 | 6/1970 | Tse | 208/11 R |
| 4,054,492 | 10/1977 | Rammler et al. | 208/11 R |

*Primary Examiner*—Delbert E. Gantz
*Assistant Examiner*—James W. Hellwege
*Attorney, Agent, or Firm*—E. P. Johnson

[57] ABSTRACT

Coked solids, produced by coking of tar sands, are contacted in a first zone with air and the minimum amount of supplemental fuel needed to burn all the coke. Part of the hot clean mineral solids produced is then discarded; the balance is moved into a second zone. Here supplemental fuel is burned to increase the temperature of the solids. The hot solids from the second zone are recycled to the coking stage.

Only part of the solids is heated with supplemental fuel, thereby reducing consumption of the latter. In addition, the flue gas from the second zone is relatively clean and can be vented directly to the atmosphere in the flue gas from the first zone.

3 Claims, 2 Drawing Figures

COKING OF BITUMINOUS SOLIDS WITH HOT SOLIDS RECYCLE

BACKGROUND OF THE INVENTION

This invention relates to an improvement to the direct coking process for obtaining hydrocarbon products by thermal upgrading of naturally-occurring hydrocarbons chemically bound or physically mixed with mineral solids, such as bituminous sands.

Although the development work to supply details for the embodiment described herein was performed using Athabasca bituminous sands as the feed material, the invention may also find application in the thermal treatment of oil shales. For simplicity and clarity, the invention is described for bituminous sands in particular, although those skilled in the oil shale art will recognize its applicability to this latter material.

Although the bitumen in naturally-occurring bituminous sands is a mixture of hydrocarbons mostly of high molecular weight, and as such is not of great economic value, such bitumen may be upgraded to hydrocarbons of lower molecular weight, mainly liquid at room temperature. These derived hydrocarbons find numerous applications in domestic and industrial use, and in transport. Hence, by suitable thermal treatment, the naturally-occurring bitumen becomes a valuable source of hydrocarbons. In view of the vastness of the deposits of bituminous or tar sands and oil shale, these raw materials are capable of filling energy and chemical feedstock needs resulting from the depletion of conventional crude oil.

A recovery method that has been successfully applied to obtaining useful hydrocarbons from tar sand uses an extraction process commonly known as the hot water process. This process takes advantage of the fact that tar sands, on being mulled with hot water and sodium hydroxide, produces a bituminous slurry, which slurry, on being diluted with further hot water and led to a settling zone, divides such that a bituminous froth rises to the surface of the water in the settling zone and may be withdrawn for further concentration of the bitumen, while sand, essentially bitumen-free, may be discarded as a downward flowing aqueous tailings stream. The bitumen obtained in the froth may be concentrated by diluting the bitumen with a naphtha solvent, after which the diluted froth is centrifuged to remove substantially all water and mineral solids. The naphtha solvent is then removed by distillation, to leave a bitumen essentially free from water, minerals, and solvent.

Once isolated, the bitumen has heretofore been processed by delayed or fluid coking. Such treatment serves three principal purposes. First, it breaks down the larger-sized molecules to species of lower molecular weight and hence higher volatility. It is these smaller molecules that find application as useful and therefore economically-valuable hydrocarbons. This aspect of thermal treatment is commonly referred to as "cracking." Secondly, the thermal treatment removes carbon from the mixture of molecules from which bitumen is composed, thus bringing the ratio of carbon to hydrogen in the mixture to such a level that the mixture consists of hydrocarbons amenable to refining in an established oil refinery. Thirdly, the thermal processing encourages the evolution of nitrogen and sulphur and other elements undesirable in the end use to which the hydrocarbons are to be put.

Although it has gained acceptance at the commercial level, the hot water process has several drawbacks. Principal among these is that the process generates large quantities of wet tailings. As a consequence, a costly tailings pond must be maintained. Another disadvantage arising from high water usage is that large quantities of heat must be used to raise the temperature of the water to the process temperature of 179° F or thereabouts, and thus heat is lost as the water leaves the process in the tailings streams. Recovery of heat is uneconomical since the difference in temperature between the tailings and the surrounds is relatively small.

The idea early suggested itself in tar sand processing that instead of extracting the bitumen and then subjecting it to thermal treatment, it would be feasible and desirable to subject the tar sand feed in its entirety to thermal treatment. This could be done by retorting the bitumen in its natural state, intimately mixed in the tar sand. Early work on such retorting of tar sand is reported by P. E. Gishler and W. S. Peterson in "Oil from Alberta Bituminous Sand" in *Petroleum Engineer* Vol. 23, Issue 23, pp. c 66-c 76(1951), and "The Fluidized Solids Technique Applied to Alberta Oil Sands Problem" in *Proceedings of the Athabasca Oil Sands Conference,* Edmonton, Alberta, pp. 207 to 236 (1951), and by R. W. Ramuler in "The Production of Synthetic Crude Oil from Oil Sand by Application of the Lurgi-Rhurgas Process" in the *Canadian Journal of Chemical Engineering* Vol. 48, pp. 552–560 (1970). The technology of the retorting of tar sand is known as, and is hereinafter referred to as, direct coking.

An important difference between the coking of bitumen and the coking of total tar sand feed is that in the case of tar sand, not only the bitumen, but also the water and the mineral solids in the tar sand must be raised to the temperature of the retorting zone. Hence provision must be made in a direct coking unit to heat the entire in-coming feed to such a temperature that moisture is vapourized, the bitumen is "cracked," and hydrocarbon products are vapourized and driven out of the reaction mixture.

The tailings from direct coking consist essentially of grains of mineral solid surrounded by coke deposit — all at high temperature. If the coked solids are merely discarded, the process would be so wasteful of heat as to be uneconomical when compared with other systems. To overcome this problem, the coked solids are conveyed to a burning chamber or zone where the coke is burned in the presence of air or oxygen. This has the effect of further raising the temperature of the mineral residue. A portion of the hot minerals may then be returned to the coking reaction zone as a convenient means for supplying the heat needed to raise the temperature of the in-coming tar sand feed. The portion of the burned mineral solids that is not returned to the reaction zone may be conveyed to heat exchangers wherein the heat is extracted, for instance, in the production of steam.

To summarize, the direct coking process involves two stages: a reacting stage, in which the tar sand is heated in the absence of air to give "cracked" hydrocarbon product, with nitrogen and sulphur released by said "cracking" being evolved in the form of nitrogen and sulphur-containing gases such as ammonia, hydrogen sulphide and sulphur dioxide; and a burning stage in which coke-enveloped mineral solids emerging from the reacting stage are burned by the addition of air or oxygen and part of the hot mineral solids are recycled to the reacting stage.

It is the burning step that is the subject of the invention described herein. To keep the process in heat balance, it is necessary to add supplementary fuel in the burning step. That is to say, the heat obtained from burning the coke adhering to the minerals is inadequate to replace the heat lost in cracking the bitumen and distilling out volatiles. For simplicity and efficiency this supplementary fuel is best added in the burning stage of the process so that the heat is in effect added to the mineral solids. This burning of supplementary fuel and burning of coke adhering to mineral particles produces waste gases that must be disposed of as they emerge from the burning zone of the process. Such gases contain noxious substances such as hydrogen sulphide or sulphur dioxide, and, as well, fine particulates. Such materials must be substantially removed before the flue gases can be vented to the atmosphere.

SUMMARY OF THE INVENTION

The present invention, by modifying the configuration of the burning zone, introduces two improvements to the process. First the quantity of supplementary fuel is reduced for reasons that will become evident hereinafter. And secondly, the flue gases are concentrated so that removal of the unwanted components is simplified and hence made less expensive.

In accordance with the invention, the combustion operation is divided into two sequential operations. In the first operation, coked solids, produced from the coking reaction zone are introduced into a coke burning zone. Here they are contacted with combustion air and the minimum amount of supplementary fuel needed, which may possibly be none, to burn substantially all the coke. One of the two products leaving this operation is a flue gas containing a relatively high concentration of pollutants, such as sulphur and nitrogen compounds and fine solids; the other product is hot clean mineral solids. These latter solids are preferably divided into two parts. One part is discarded while the other, required for heating the coking reaction zone, is introduced into a fuel burner zone. Here the major portion or all of the supplemental fuel required to maintain heat balance is combusted with air or oxygen to further heat the clean solids until their heat content is sufficient to meet the requirements of the coking reaction zone. These supplementally heated solids are then recycled to the coking reaction zone. Also, a second flue gas is produced from the fuel burner zone which is relatively low in pollutants content.

If a direct coking unit is run without the benefit of the present invention, the clean flue gas from the combustion of supplementary fuel is contaminated with the obnoxious material evolved by the combustion of the coke. Because the obnoxious material is thus diluted throughout a relatively large volume of flue gas, it is more difficult to remove. Hence it is a first advantage of the invention that, by its use, a portion of the flue gas is not contaminated, and in that portion that is contaminated, the contaminants are concentrated, so that their removal is rendered relatively easy.

A second advantage relates to the improved heat efficiency introduced by the invention. Hot mineral solids returned to the reactor zone must be at high temperature to supply enough heat for reacting the in-coming tar sand feed. The temperature selected for the re-cycling minerals is 1300° F or thereabouts. If excess solids are discarded after the burning step, then without the benefit of the invention, all mineral solids, including that portion that is discarded from the process, are heated to this high temperature. According to the invention however, the coke burner zone may be operated at a lower temperature than the fuel burner zone. Then the solids from the cooler coke burner zone are divided, with one part being removed from the process and the other part being further heated in the fuel burner zone, for re-cycling to the reaction stage. A saving in supplementary fuel needed to keep the process in heat balance is obtained. Even if the excess mineral solids are discarded before the burning step, the invention allows a lower temperature flue gas from the combustion of coke than the prior art, and thus some saving in supplementary fuel is still obtained.

Broadly stated, the invention is an improvement of the process wherein a feed stock comprising naturally occurring hydrocarbons associated with mineral solids, such as bituminous sands, are thermally cracked in a coking reaction zone, and coked solids produced therefrom are introduced into a burning zone wherein the coke is burned from the solids, supplemental fuel addition to said burning zone being required to maintain heat balance, and part or all of the produced hot clean solids, having a required heat content, is recycled to the coking reaction zone to supply heat thereto. The improvement comprises burning substantially all the coke of the coked solids in a coke burning zone with air or oxygen and the minimum amount of supplemental fuel needed, to produce clean hot solids and flue gas containing a relatively high concentration of pollutant compounds and fine solids; introducing at least part of the clean hot solids into a fuel burning zone and combusting at least the major portion of the supplemental fuel needed to maintain heat balance and air or oxygen in said zone to further heat the solids, thereby producing clean supplementally heated solids, having the heat content required for the coking reaction zone, and flue gas containing a relatively low concentration of pollutant compounds and fine solids; and recycling supplementally heated solids to the coking reaction zone for heating.

The invention and its advantages are illustrated by the following example:

EXAMPLE

Figure 1:
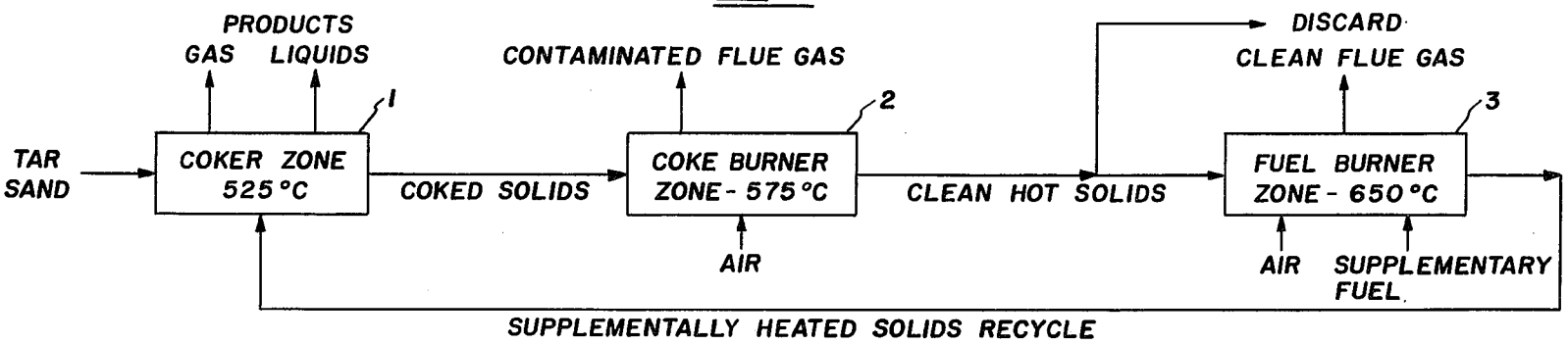
FIG. 1 is a schematic showing a direct coking operation embodying the invention.
Figure 2:
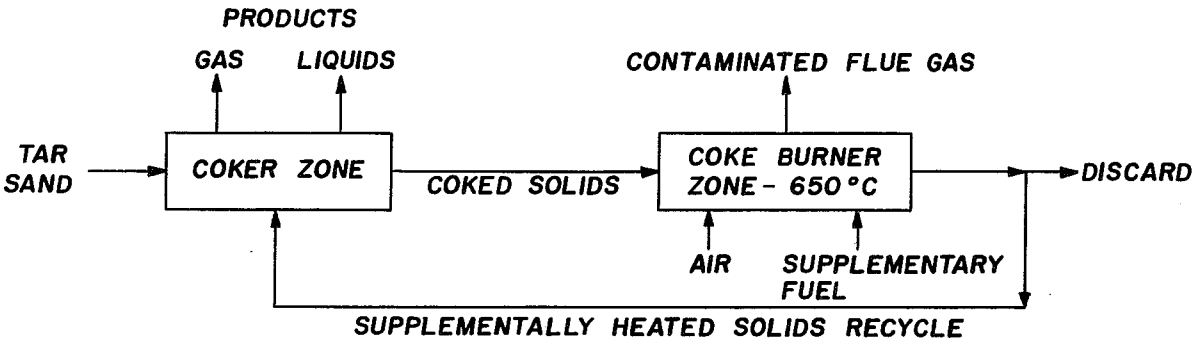
Fig. 2. (PRIOR ART)
FIG. 2 is a schematic showing a prior art embodiment of a direct coking operation for tar sands.

With reference to FIG. 1, 1 kilogram of tar sand feed, comprising 11.6 weight % bitumen, 4.4% water and 84% solids, is added to a coker zone 1. Here it is mixed with 5.64 kilograms of hot solids recycle coming from a fuel burner zone 2. The two streams reach an ultimate temperature of about 525° C, whereupon hydrocarbon and water vapors are released and pass out of said zone. Approximately 12% of the hydrocarbons in the feed forms non-condensable gases, 72% is vaporized to condensable gases, and the balance forms a coke layer on the grains of solids.

6.50 Kilograms of coked solids are conveyed from the coker zone 1 into a coke burner zone 2. Here they are mixed with 0.16 kilograms of air and burned to remove the coke. Burning is conducted to produce a 2/1 $CO_2$ to CO ratio in the flue gas. The clean solids leave the coke burner zone at a temperature of about 575° C. About 0.176 kilograms of flue gas are produced, containing contaminants including $H_2S$ and fine particulates.

Approximately 0.84 kilograms of clean hot solids (i.e. an amount equal to the solids introduced in the feed) is preferably discarded from the stream leaving the coke burner zone 2. The remaining 5.64 kilograms of hot clean solids are introduced into a fuel burner zone 3. Here 0.20 kilograms of air and 0.013 kilograms of refinery fuel gas are combusted completely to raise the temperature of the solids to 650° C. Approximately 0.211 kilograms of flue gas are produced from the fuel burner zone 3. This flue gas is essentially free of contaminants and can be released directly to the atmosphere. The 5.64 kilograms of solids at 650° C produced from the zone 3 are recycled to the coker zone 1.

For purposes of comparison, the results of a direct coking operation in accordance with the prior art are now described. Again, 1 kilogram of the same tar sand feed is introduced into the coker zone 4 and mixed with 5.64 kilograms of recycled solids at 650° C. The 6.50 kilograms of coked solids from the coker zone 4 are conveyed into a burner zone 5. Here the solids require 0.016 kilograms of refinery fuel gas and 0.40 kilograms of air for combustion of the coke, at a $CO_2$ to CO ratio of 2/1 and the gas at a $CO_2$ to CO ratio of infinity to produce clean solids at 650° C, part of which is recycled to the coker zone 4. Approximately 0.43 kilograms of contaminated flue gas are produced from the burner zone 5.

From the foregoing, it will be noted that there is a significant concentration of contaminants in the flue gas from the combustion of the coke, and a reduction of supplementary fuel consumption when the invention is practised.

What is claimed is:

1. In the process wherein a feed stock comprising naturally occurring hydrocarbons associated with mineral solids, such as bituminous sands, are thermally cracked in a coking reaction zone, and coked solids produced therefrom are introduced into a burning zone wherein the coke is burned from the solids, supplemental fuel addition to said burning zone being required to maintain heat balance, and part or all of the produced hot clean solids, having a required heat content, is recycled to the coking reaction zone to supply heat thereto, the improvement comprising:

burning substantially all the coke of the coked solids in a coke burning zone with air or oxygen and the minimum amount of supplemental fuel needed, to produce clean hot solids and flue gas containing a relatively high concentration of pollutant compounds and fine solids;

introducing at least part of the clean hot solids into a fuel burning zone and combusting a further portion of supplemental fuel needed to maintain heat balance and air or oxygen in said zone to further heat the solids, thereby producing clean supplementally heated solids, having the heat content required for the coking reaction zone, and flue gas containing a relatively low concentration of pollutant compounds and fine solids; and recycling supplementally heated solids to the coking reaction zone for heating.

2. The improvement as set forth in claim 1 wherein: the feed stock is bituminous sands.

3. The improvement as set forth in claim 2 wherein: only that part of the clean hot solids required for recycling is introduced into the fuel burning zone.

* * * * *